United States Patent [19]

Baker

[11] 4,342,359

[45] Aug. 3, 1982

[54] UNIVERSAL FLUE STACK HEAT EXCHANGER

[76] Inventor: Jack T. Baker, R.D. 1 Box 413, Greenwich, N.Y. 12834

[21] Appl. No.: 116,512

[22] Filed: Jan. 29, 1980

Related U.S. Application Data

[63] Continuation of Ser. No. 857,737, Dec. 12, 1977, abandoned.

[51] Int. Cl.[3] ..... F24B 7/02; F28F 13/14

[52] U.S. Cl. ..... 165/47; 165/76; 165/122; 165/134 DP; 165/137; 165/DIG. 2; 237/55

[58] Field of Search ..... 237/55; 165/134 R, 134 DP, 165/137, 146, 76, DIG. 2, 47, DIG. 12, 151, 122

[56] References Cited

U.S. PATENT DOCUMENTS

| | | | |
|---|---|---|---|
| 2,343,542 | 3/1944 | Faunce | 165/DIG. 2 |
| 2,430,631 | 11/1947 | Eskra | 165/137 |
| 2,468,909 | 5/1949 | Yeager et al. | 237/55 |
| 2,487,626 | 11/1949 | Wittman | 165/137 |
| 2,613,065 | 10/1952 | Didier | 165/146 |
| 3,036,818 | 5/1962 | Legrand | 165/137 |
| 3,543,843 | 12/1970 | Gunter | 165/134 |
| 3,934,798 | 1/1976 | Goldsmith | 237/55 |
| 4,050,627 | 9/1977 | Mayer | 165/DIG. 2 |
| 4,078,602 | 3/1978 | Richer | 165/DIG. 2 |
| 4,125,153 | 11/1978 | Stoneberg | 165/DIG. 2 |
| 4,194,488 | 3/1980 | Bellaff | 237/55 |
| 4,219,073 | 8/1980 | Talmadge et al. | 237/55 |

FOREIGN PATENT DOCUMENTS

| | | | |
|---|---|---|---|
| 853756 | 11/1960 | United Kingdom | 165/146 |

*Primary Examiner*—Sheldon J. Richter

*Attorney, Agent, or Firm*—Seidel, Gonda, Goldhammer & Panitch

[57] ABSTRACT

A heat exchanger that is universally usable in the flue stack of a heating appliance and yet is efficient and capable of properly matching the rate of heat exchange to the heat rating of the heating appliance. The basic elements of the heat exchanger which affect heat transfer, include the length and diameter of the flue gas tubes, the tube support structure defining the tube spacing, air flow baffles, air openings and the size of the blower are held constant. To match the amount of heat recovery from the flue gas to the heat rating of heating appliance, only the amount of heat exchange surface area (finning) is varied from heat exchanger to heat exchanger. Further, the heat exchanger includes a heat transfer section which is readily separable from the flue gas inlet and outlet assemblies for cleaning or repair without the need for complete removal of the entire heat exchanger from the flue stack.

3 Claims, 10 Drawing Figures

FIG. 1
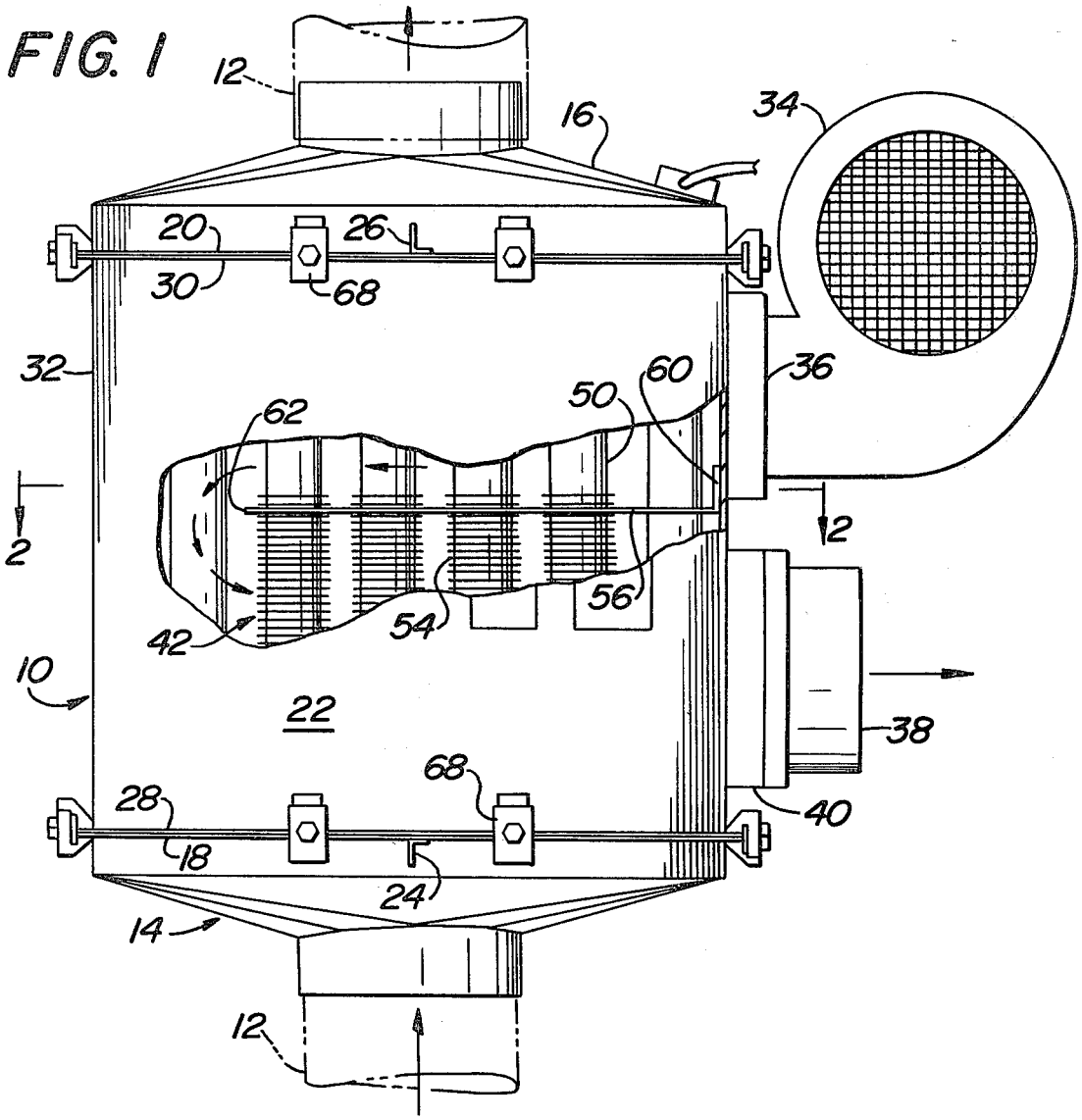
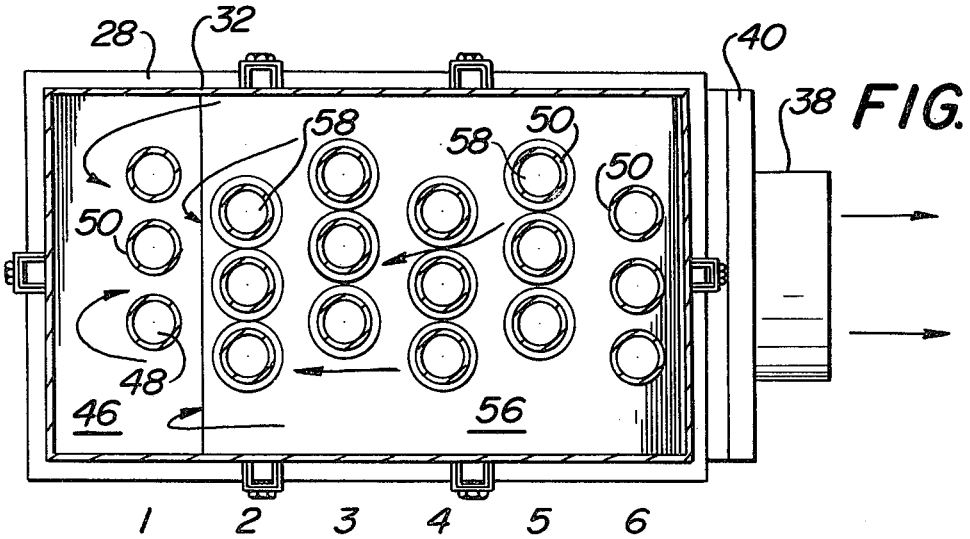
FIG. 2

FIG. 3
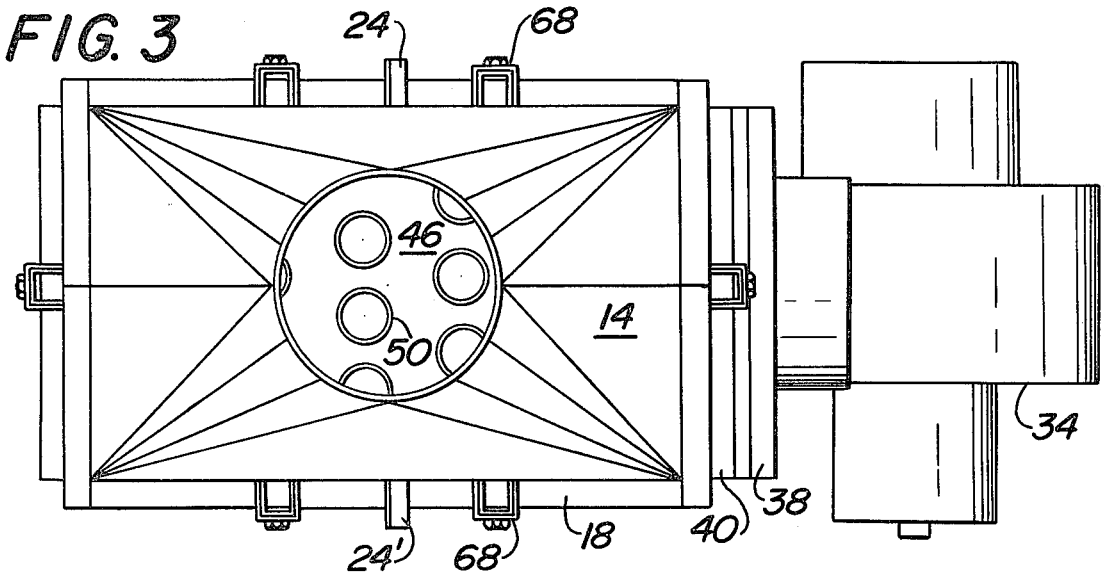
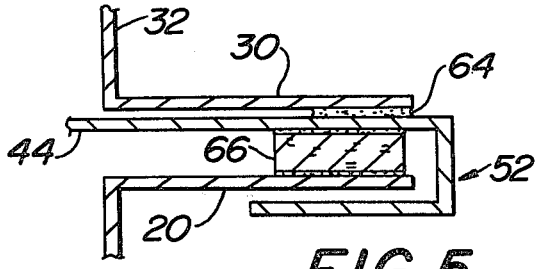
FIG. 5
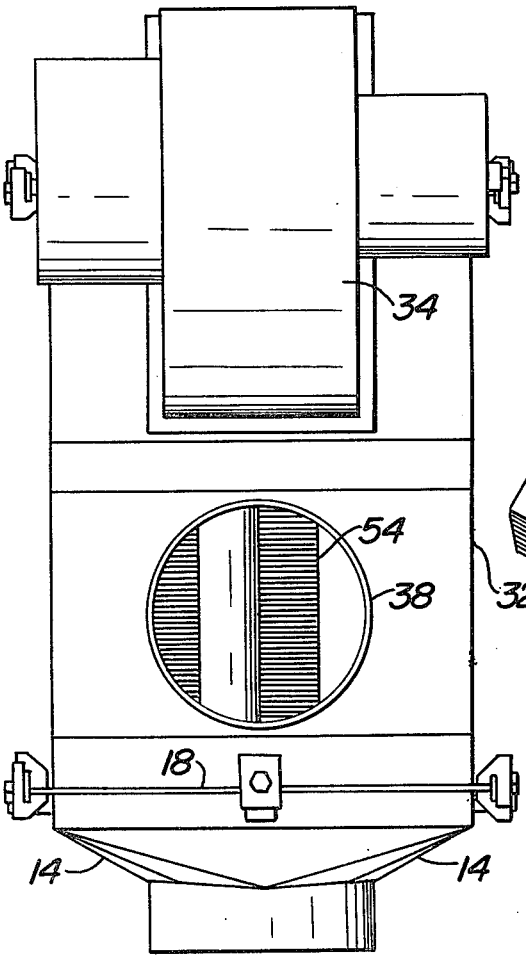
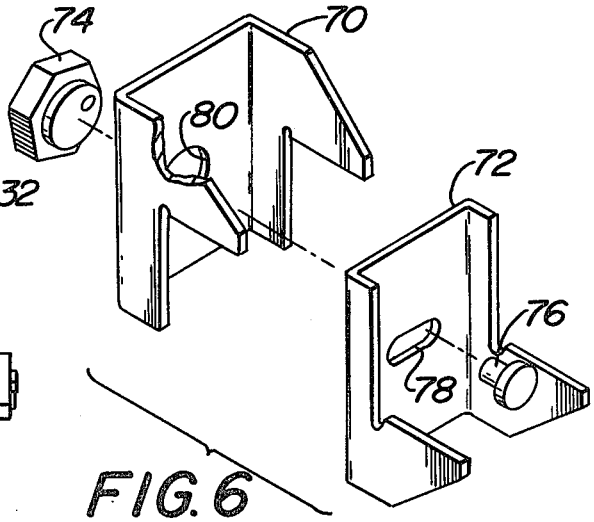
FIG. 6
FIG. 4

UNIVERSAL FLUE STACK HEAT EXCHANGER

This is a continuation of application Ser. No. 857,737, filed Dec. 12, 1977, now abandoned.

This invention relates to a universal flue stack heat exchanger. More particularly, this invention relates to a heat exchanger that uses a basic set of components which affect the rate of exchange of heat from the flue stack gases to the fluid flowing through the device while also being efficient and capable of properly matching the rate of heat exchange to the heat rating of the primary heating appliance. All but one of the basic components of the heat exchanger which effect the heat exchange are held constant. These include the dimensions (e.g., length and diameter) of the flue gas tubes which affect the flue gas flow rate; the support structure determining the spacing between tubes which also affect the gas flow rate; air flow baffles, air input and output openings and the size of the blower which affect air flow rate; and type and grade of metal as well as tolerances which affect heat exchange. Only the heat transfer area in the form of finning for the tubing is varied to properly match the amount of rate of heat recovery to the heat rating of the heating appliance.

Most small heating appliances, such as oil, gas and coal home heating appliances, are rather inefficient. Typically, an oil fired home heating appliance has a maximum efficiency of between 65 to 75 percent. This means that there is a large amount of heat energy in the exhaust flue stack gases. The present invention is a heat exchanger for use in the flue stack of a heating appliance whereby a large amount of the energy in the flue stack gases can be recovered for further use.

It is known to interpose a heat exchanger in the flue stack of a heating appliance. Typically devices designed for this purpose pass the flue gases through finned tubes. A blower or some other means is provided for moving fluid such as air over the surface of the tubing and fins to effect an exchange of heat between the flue gases and the air. The thus heated air is then recirculated back into the primary system of the heating appliance or conducted through ducts or the like to provide secondary or even primary heating of a designated space or volume; e.g., a room in a home. Although this general concept is known, certain constraints are placed on the design of the heat exchangers which create difficult problems in the implementation of the concept. Among these is the requirement of providing a unit which efficiently transfers the heat from the flue stack gases to the air or other fluid medium flowing through the heat exchanger. This is complicated by the necessity of maintaining a minimum stack gas temperature so as not to adversely affect the operation or safety of the primary heating appliance. For example, Underwriters Laboratory will not approve any flue stack heat exchanger that reduces the flue gas temperature of a home heating appliance below 300° F. Consequently, the rate of heat exchange of the heat exchanger must be carefully matched to the heat rating of the heating appliance which determines heat value and flow rate of the flue gas on the input side of the heat exchanger. Stated more particularly, the heat exchange rate must be properly matched to the heat value (BTU) and flow of the flue gas which is usually measured in terms of weight per unit of time (e.g., pounds/hour).

The requirement for matching in turn creates severe manufacturing problems due to the vast number of kinds and sizes of heating appliances now in use. A commercially practical heat exchange unit necessarily requires that there be a minimum number of models. Otherwise, the cost of the heat exchangers is made prohibitive by the expense of manufacturing and maintaining inventories for too many models. Stated otherwise, the costs of such units would be out of proportion to the savings which they could provide by the recovery of heat energy from flue stack gases.

In accordance with the present invention, there is provided an efficient heat exchanger whose thermal heat transfer characteristics can be balanced with most heating appliances such as are used in the home and yet be manufactured in a minimum number of basic units or models. More particularly, the present invention provides a universal heat exchanger in which the basic design is efficient and comprises as fixed components the flue gas tubes, the frame or support structure for the tubes, the air flow baffles, the air openings, the size of the blower, types and grades of metal and tolerances. These are the basic components which effect the heat transfer rate. To match the rate of heat recovery from the flue gas to the heat value of the flue gas on the input side of the basic heat exchanger unit, only the amount of heat exchange surface in the form of finning is varied from unit to unit. Since the number of flue gas tubes and their dimensions are fixed, the addition or removal of finning to vary the heat transfer rate is relatively straightforward from a manufacturing and cost point of view. Still further, by fixing all of the other parameters which affect the heat transfer rate, a relatively efficient device can be designed for use in practically all heating appliances.

Since the present invention is principally, although not exclusively, intended for use with small heating appliances such as are present in the home, it is advantageous to provide a unit which is relatively simple to install and maintain. In accordance with the present invention, the heat exchanger is manufactured in three separable sub-assemblies comprising flue gas inlet and outlet assemblies which are mounted on the flue stack and the heat transfer section including the blower which is mounted between the inlet and outlet assemblies by means of a slip joint. As thus mounted, the heat transfer section can be readily removed for repair and cleaning.

For the purpose of illustrating the invention, there is shown in the drawings forms which are presently preferred; it being understood, however, that this invention is not limited to the precise arrangements and instrumentalities shown.

FIG. 1. is a plan view of the heat exchanger.

FIG. 2 is a sectional view taken along the line 2—2 in FIG. 1.

FIG. 3 is an end view of the heat exchanger.

FIG. 4 is another plan view of the heat exchanger showing the air outlet.

FIG. 5 is a detail view of the slip joint showing how the heat transfer section is attached to the gas inlet or gas outlet assembly.

FIG. 6 is a perspective view of a fastener for joining the heat transfer section to the gas inlet or outlet assembly.

Referring to the drawings in detail, wherein like numerals indicate like elements, there is shown in FIG. 1 a heat exchanger in accordance with the present invention designated generally as 10. The heat exchanger 10 is mounted in a flue stack 12 (shown on phantom) and includes a flue gas inlet assembly designated generally as 14 and a flue gas outlet assembly designated generally as 16. The inlet and outlet assemblies 14 and 16 are conventionally joined to the flue stack 12 by a friction fit. The arrows adjacent the inlet and outlet assemblies 14 and 16 illustrate the direction of flow of the flue gases through the heat exchanger 10. Although not shown, the inlet assembly 14 may include a baffle for evenly distributing the flue gases across the face of the end plate which supports the flue gas heat exchange tubes. Otherwise, the inlet and outlet assemblies 14 and 16 are sheet metal structures constructed as shown for a friction fit with conventional 6, 7 or 8 inch diameter flue gas stacks. The inlet and outlet assemblies 14 and 16 are also provided with flanges 18 and 20 which extend around their entire periphery at the end juxtaposed to the heat transfer section designated generally as 22. The flange 18, which is exemplary of flange 20, is best seen in FIG. 3. The flanges 18 and 20 cooperate in a manner to be described below with opposing flanges 28 and 30 at the inlet and outlet ends of the housing 32 for the heat transfer section 22. Hanger brackets, such as the brackets 24, 24' and 26, are welded or otherwise attached to the flanges 18 and 20. These brackets and others like them can be used for providing additional support as by means of wires or straps fixed to a wall or other structure.

Figure 7:
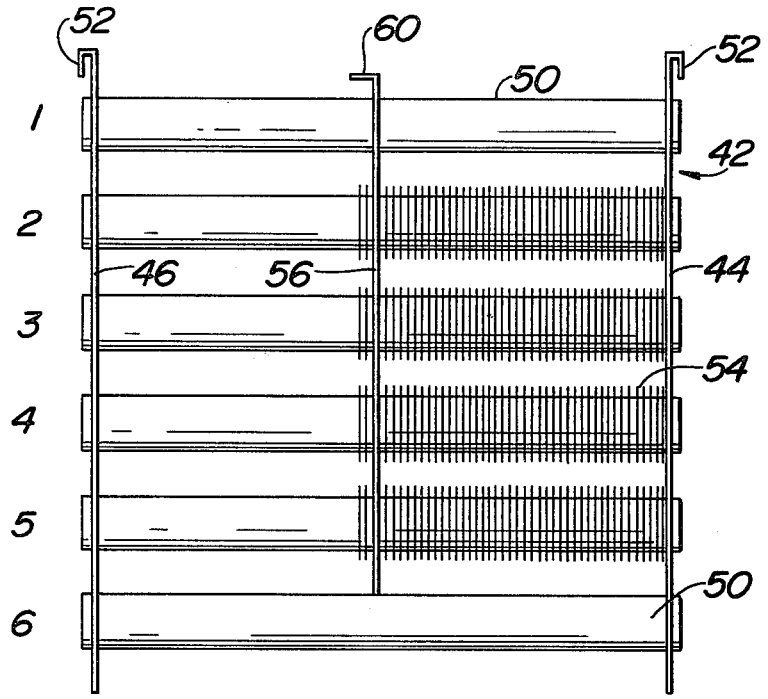
FIGS. 7, 8, 9 and 10 are elevational views of convector sub-assemblies showing various finning patterns for an oil fired unit.

The heat transfer section 22 comprises an electric motor driven blower 34 sized to force the flow of air through the heat transfer section at the desired flow rate measured in volume per unit of time. The blower 34 is mounted on an opening in a collar 36. The size of the opening in collar 36 is selected according to the basic requirements of the heat exchanger 10 in terms of the rate of air flow through it. An air outlet 38 is provided in the collar 40 as shown in FIG. 1. The outlet 38 is also sized as required for the correct flow of air through the unit. It should be noted that the blower 34 is mounted on the collar 36 so that air enters the housing 32 adjacent the outlet assembly 16. The air flows through the unit in the manner described below and exits through the outlet 38 which is adjacent the inlet assembly 14. Thus, the flow of air is from the cool side to the relatively hotter side of the connector assembly 42.

The convector assembly 42 is mounted within the housing 32 as best shown in FIGS. 1 and 2. Referring to FIG. 7, the convector assembly 42 comprises the end plates 44 and 46 within which are provided a plurality of punched and flared holes 48. The end plates 44 and 46 extend completely across the inlet and exit ends of the housing 32 and provide the support structure for the tubes 50 which are mounted within the holes 48 by means of a pressure fit and/or welding. The upper end of each of the end plates 44 and 46 is formed to define a hook or channel-like structure 52 extending across the width thereof. As shown in FIGS. 1, 4 and 7–10, and for the reasons explained herein, some but not all of the tubes 50 are provided with fins 54.

As shown in FIGS. 1 and 2, a baffle 56 is positioned intermediate the inlet in collar 36 and the outlet 38. The baffle 56 is provided with holes 58 through which the tubes 50 extend and is also provided with a flange 60 which permits it to be welded or otherwise fixed to the inner wall of the housing 32. Baffle 56 extends across the entire width of the housing 32 as shown in FIG. 2 but it does not extend across the entire length of the housing as illustrated in FIG. 1. Thus, the function of the baffle 56 is to divide the convector assembly into air inlet and air outlet sectors and thus direct the flow of air from blower 34 across the tubes 50 and any finning that may be on them first at the outlet side of the heat transfer section 22 and then at the inlet side of the heat transfer section.

Referring to FIG. 5, the end plate 44 is welded to the flange 30 at the end of the housing 32 by means of the weldment 64. In a like manner, the end plate 46 is fixed to the flange 28.

To mount the heat exchanger 10, the inlet and outlet assemblies 14 and 16 are first fitted onto the flue stack 12 in facing relation. They may be braced by appropriate connections to the brackets 24 and 26. The entire heat transfer section 22 is then mounted in position between the inlet and outlet assemblies 14 and 16 by sliding the channel 52 over the flanges 18 and 20 as shown in FIG. 5. A sealing gasket 66 is positioned between the flanges and end plates. The hook-like structure of the channel 52 temporarily holds the heat transfer section 22 in position until the fasteners 68 can be placed in position. Thus, the heat transfer section 22 is joined to the inlet and outlet assemblies 14 and 16 by a slip joint.

Although the inlet and outlet assembly can be fixed to the heat transfer section 22 by any conventional fastener, in a preferred embodiment the fastener may be a quick release fastener as illustrated in FIG. 6. The fastener of FIG. 6 comprises jaws 70 and 72 which fit together in sliding relation. They are held in that relationship by the hex head 74 which is eccentrically joined to the shaft 76 which extends through slot 78 and opening 80. By turning the hex head 74, the jaws 70 and 72 open or close to clamp the above-described flanges against the gasket 66.

Figure 8:
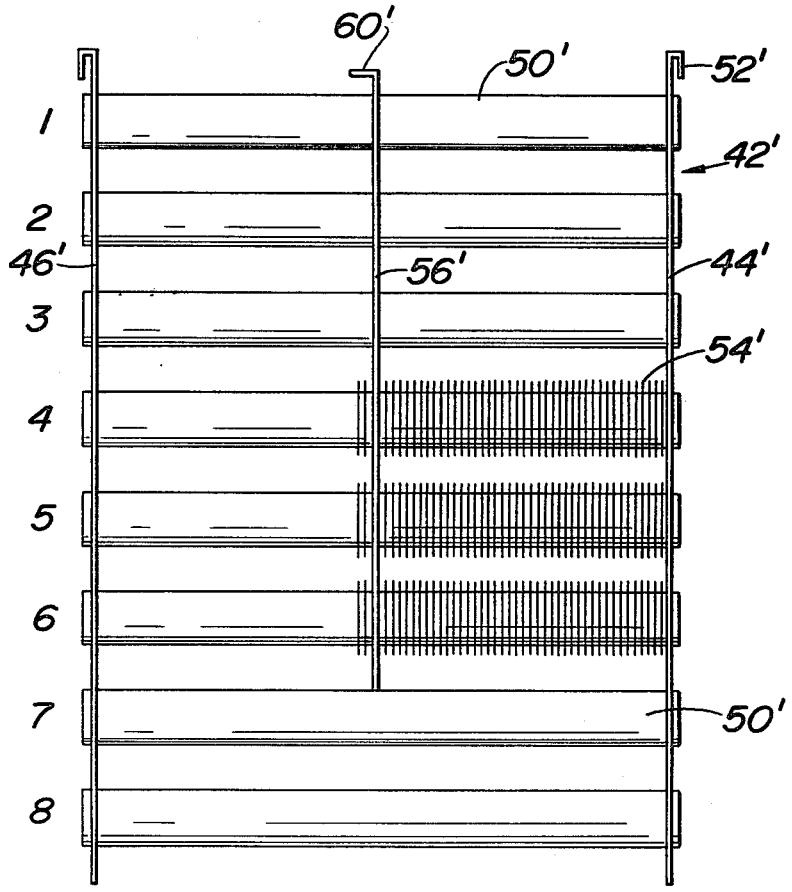
Figure 9:
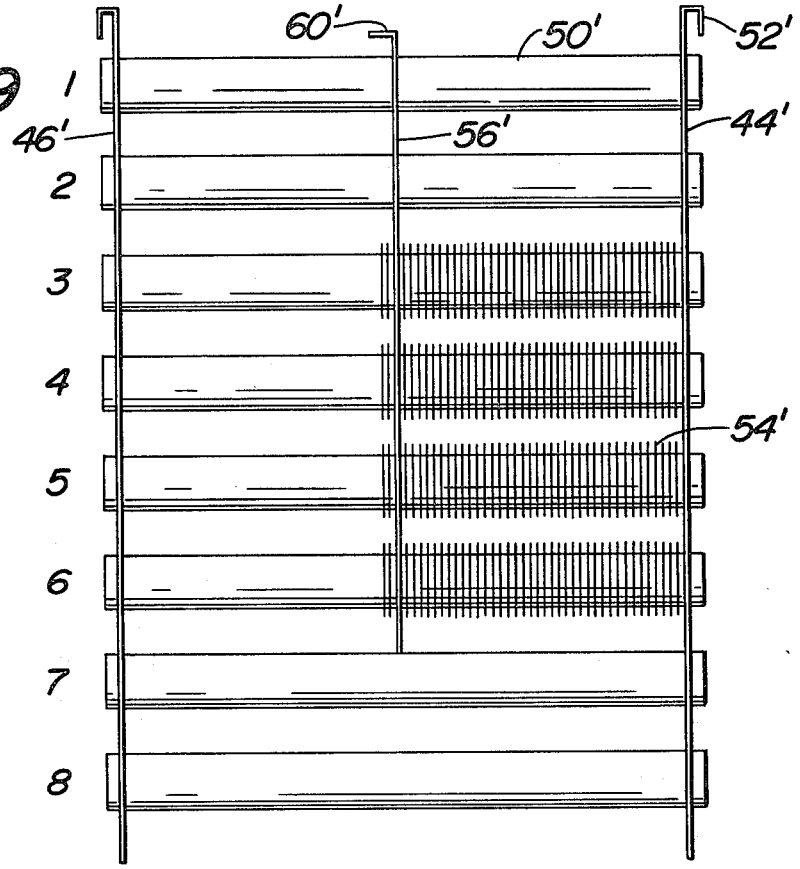
Figure 10:
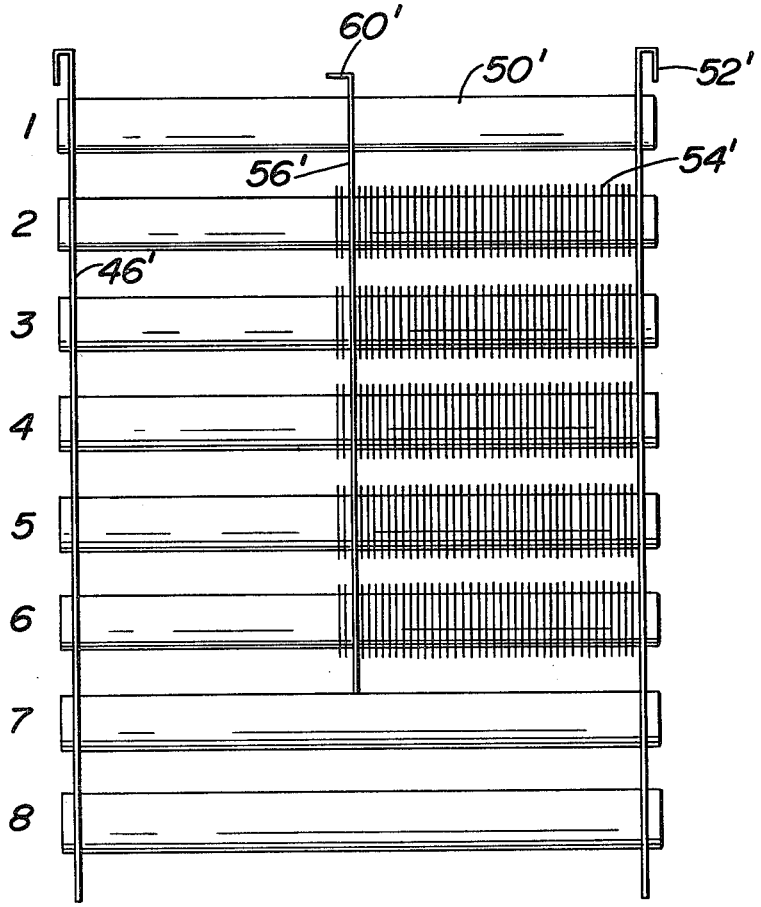

The basic structure of the heat exchanger thus far described can be universally fitted to most home heating appliances by varying only the amount of finning for the flue gas tubes 50 within only two basic models. The two models are a first model sized for use with a home heating appliance having a 6 inch diameter flue stack (FIGS. 1–7) and a second model sized for use with 7 or 8 inch diameter flue stacks (FIGS. 8–10). The necessity of varying the inlet and outlet openings of assemblies 14 and 16 as between 7 and 8 inches is not considered to be significant as the unit could be standardized at one size or the other because 7 to 8 inch reducing collars are commonly available.

Within each model, the heat exchange parameters are standardized for all parameters which affect the heat transfer characteristics except area of heat transfer surface. The basic components which are not varied within a particular model are the length and diameter of the tubes 50, the size of the end plates 44 and 46, the size of the baffle 56, the capacity or size of the blower 34, the inlet and outlet openings for the air from the blower, the size of the housing, and any controls such as temperature limit controls. To vary the amount of heat energy recovered from the flue gases as determined by the amount of heat energy in such gases as they enter the inlet assembly, only the finning is varied within each model. The basic difference between each model is the 7 and 8 inch flue stack model has more tubes 50, a larger volume for the housing 32 and larger sized end plates and baffle.

The housing 32, end plates 44 and 46, baffle 56, inlet assembly 14 and outlet assembly 16 can all be made of galvinized mild sheet steel. The tubes may be carbon steel and the fins aluminum.

The capacity of the blower 34 for the 6 inch flue stack model as well as the blower for the 7 and 8 inch flue stack model may be: 525 $ft^3$/Min in free air.

By way of example, all tubes 50 for both models may be 1½ inch in diameter and 15½ inches in length. The fins for both models are 2½ inches in diameter. There are 8 per inch. The end plates for the 6 inch diameter model may be 19¼ inches in length by 10-27/32 inches in width. The end plates for the 7 and 8 inch model may be 23¼ inches in length by 13-7/16 inches in width. The 6 inch model uses 18 tubes in 6 staggered rows of 3 tubes each as shown in FIGS. 2 and 7. The center to center spacing between tubes in a row and from row to row is 2⅝ inches. The 7 and 8 inch model (FIGS. 8–10) may include 32 tubes in 8 staggered rows of 4 tubes with a center to center spacing of 2⅝ inches within a row and from row to row. The inlet and outlet openings for the 6 inch model are approximately 70 square inches and the inlet and outlet openings for the 7 or 8 inch model are approximately 90 square inches.

As previously stated, for each furnace in which one or the other of the two models is installed, it is necessary to match the amount of heat recovery from the flue gas to the heat rating of the heating appliance. Since all of the parameters which affect the rate of heat exchange, even including the type and grade of metal, tolerances, air velocity and gas flow are fixed within design limitations, the only variable is the amount of heat transfer surface which is controlled by the amount of finning. This in turn is established by the heating appliance which determines the value of the heat at the entrance to the inlet assembly 14. Another fixed requirement is the maintenance of a minimum flue gas temperature at the exit of the outlet assembly 16.

It has been found that a practical finning constant (K) exists as long as the aforesaid parameters are fixed. This constant (K) can be stated in units of heat energy transferred to the air per unit area per unit of time per unit of temperature (e.g., BTU/$ft^2$/hr/F°). The constant for a particular model is determined empirically. Once known, the area of finning can be calculated for the heating appliance. For the model described above, K=2.879 BTU/$ft^2$/hr/F°.

Variations in the amount of finning varies the total amount of heat transfer surface and thus changes the heat recovery rate. It has been found that a particular finning pattern within the foregoing example is valid over a range of 30,000 BTUs heating appliance rating. By way of example, not limitation, the following finning patterns were developed for 6 and 7 or 8 inch models for oil fired home heating assemblies where a minimum flue gas temperature of 300° F. must be maintained at the exit end of the outlet assembly 16. The finning patterns for the 7 or 8 inch models are illustrated in FIGS. 8, 9 and 10 which show the convector assembly in primed numbers; e.g., 42', 50', et seq. The finning pattern for the 6 inch model is illustrated in FIG. 7. The basic structure for both models is shown in FIGS. 1–6 but with a finning pattern for a 6 inch model.

For ease of description, the rows of tubes have been numbered 1 through 8 in FIGS. 8–10 and 1 through 6 in FIGS. 2–7. Units of heat energy are given in British thermal units (BTU) although it should be understood that metric units such as the calorie could also be used. All references are to oil fired household appliances weighted in thousands of BTUs (kBTU).

The finning pattern for 7 or 8 inch diameter flue stacks may be as follows:

(a) 8 tubes finned in rows 4 and 5 on the air outlet side only for appliances which are rated at a maximum of 120 and a minimum of 90 kBTUs.

(b) 12 tubes finned in rows 4, 5 and 6 on the air outlet side only for appliances which are rated at a maximum of 140 and a minimum of 110 kBTUs (see FIG. 8).

(c) 16 tubes finned in rows 3, 4, 5 and 6 on the air outlet side only for appliances which are rated at a maximum of 180 and a minimum of 150 kBTUs (see FIG. 9).

(d) 20 tubes finned in rows 2, 3, 4, 5 and 6 on the air outlet side only for appliances which are rate at a maximum of 180 and a minimum of 150 kBTUs at the entrance end of the inlet assembly (see FIG. 10).

For the 6 inch diameter model, the exemplary finning patterns are as follows:

(a) 12 tubes finned in rows 2, 3, 4 and 5 on the air outlet side only for appliances which are rated at a maximum of 100 and a minimum of 80 kBTUs (see FIG. 7).

(b) 9 tubes finned in rows 2, 3 and 5 on the air outlet side only and 3 tubes finned in row 4 finned in both the inlet and outlet side for appliances which are rated at a maximum of 120 and a minimum of 90 kBTUs.

(c) 6 tubes finned in rows 2 and 5 on the air outlet side only and 6 tubes finned in rows 3 and 4 on both the air inlet and air outlet side for appliances which are rated at a maximum of 140 and a minimum of 110 kBTUs.

It should be understood that the foregoing is given by way of example and is not intended to limit the invention. By appropriate modification, finning patterns can be developed for gas or coal fired heating appliances. The present invention is principally intended for use in retrofitting to home appliances. Still further, although the present invention is principally intended for use in small heating appliances such as are used in the home, the principles are also applicable to large industrial size heating appliances.

The present invention may be embodied in other specific forms without departing from the spirit or essential attributes thereof and, accordingly, reference should be made to the appended claims, rather than to the foregoing specification as indicating the scope of the invention.

It is claimed:

1. A universal flue gas heat exchanger for use in combination with a flue stack of any one of a multiplicity of heating appliances which may require different rates of heat exchange from the flue gases without affecting the safe operation of the heating appliance, comprising:

(a) an enclosed housing to replace a section of an interrupted flue stack, said housing having an inlet assembly at one end thereof for receiving a lower portion of the interrupted flue stack and an outlet assembly at the other end thereof for receiving an upper portion of the interrupted flue stack, said enclosed housing and inlet and outlet assemblies defining an enclosed heat exchange chamber;

(b) a multiplicity of straight hollow tubes for conducting flue gases through the heat exchange chamber in parallel paths between the inlet assembly and the outlet assembly;

(c) blower means for forcing air to be heated through an entrance opening in the housing into the heat exchange chamber;

(d) an exit opening in the housing to allow heated air to exit the heat exchange chamber;

(e) a pre-determined number of said tubes, less than the total number of said tubes, having spaced heat-conducting fins, the number of tubes with fins being selected to provide a rate of overall heat exchange for the heat exchanger which is matched to the heating appliance in order to provide efficient recovery of heat from the flue gases without affecting the safe operation of the heating appliance;

(f) the entrance opening for the air to be heated being located in the housing near the outlet assembly, and the exit opening to allow heated air to exit the heat exchange chamber being located in the housing near the inlet assembly and generally directly below the entrance opening, and further comprising a baffle plate located within the heat exchange chamber intermediate said entrance and exit openings to direct the air to be heated in a generally U-shaped path across first the upper portion of said tubes and then across the lower portion of said tubes, whereby the temperature differential between the air to be heated and the flue gases inside the tubes is made more uniform along the tube length;

(g) said tubes which are finned having the fins concentrated along the length of the tube below said baffle.

2. A heat exchanger as in claim 1, wherein the fins are thin circular plates depending radially outward from the circumference of said tubes, and said plates are coaxial with said tubes.

3. A heat exchanger as in claim 1, wherein said inlet assembly and said outlet assembly is made detachable from said housing by openable fasteners, whereby the tubes may be exposed for cleaning.

* * * * *